US008011651B2

(12) United States Patent
Morita et al.

(10) Patent No.: US 8,011,651 B2
(45) Date of Patent: Sep. 6, 2011

(54) ORIGINAL-FEEDING DEVICE

(75) Inventors: Kenji Morita, Toride (JP); Shigemichi Hamano, Abiko (JP); Nobuo Sekiguchi, Moriya (JP); Akiko Kanno, Kashiwa (JP); Satoshi Seki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/636,355

(22) Filed: Dec. 11, 2009

(65) Prior Publication Data

US 2010/0148423 A1 Jun. 17, 2010

(30) Foreign Application Priority Data

Dec. 17, 2008 (JP) ..... 2008-321631

(51) Int. Cl.
*B65H 5/00* (2006.01)

(52) U.S. Cl. ..... 271/10.03; 271/265.01; 271/265.02

(58) Field of Classification Search ..... 271/10.03, 271/117, 118, 4.03, 265.01, 265.02
See application file for complete search history.

(56) References Cited

U.S. PATENT DOCUMENTS 6,076,821 A * 6/2000 Embry et al. ..... 271/10.01
6,126,160 A * 10/2000 Ebert et al. ..... 271/10.03
6,131,898 A * 10/2000 Hiroi et al. ..... 271/10.03
7,156,387 B2 * 1/2007 Hidaka et al. ..... 271/10.02
7,159,391 B2 * 1/2007 Kogo et al. ..... 60/297
7,275,740 B2 * 10/2007 Able et al. ..... 271/10.01
7,628,393 B2 * 12/2009 Mitsuya et al. ..... 271/10.01
2005/0225022 A1 * 10/2005 Akiyama et al. ..... 271/10.03

FOREIGN PATENT DOCUMENTS

JP 2001-146329 5/2001

* cited by examiner

*Primary Examiner* — Kaitlin Joerger
(74) *Attorney, Agent, or Firm* — Canon USA Inc IP Division

(57) ABSTRACT

An original-feeding device includes an original tray, a pickup roller configured to be lowered onto originals stacked on the tray and to feed one of the originals, the pickup roller configured to be lifted up after the feeding, a conveyor configured to convey the fed original, a length detector configured to detect a length of the conveyed original, an original sensor configured to detect a trailing edge of the conveyed original, and a controller configured to control the pickup roller either in a first mode in which the pickup roller is lowered in accordance with a detected length of the original or in a second mode in which the pickup roller is lowered at the detection of a trailing edge of the original. The controller changes the first mode to the second mode if lengths of the originals detected by the length detector vary.

5 Claims, 11 Drawing Sheets

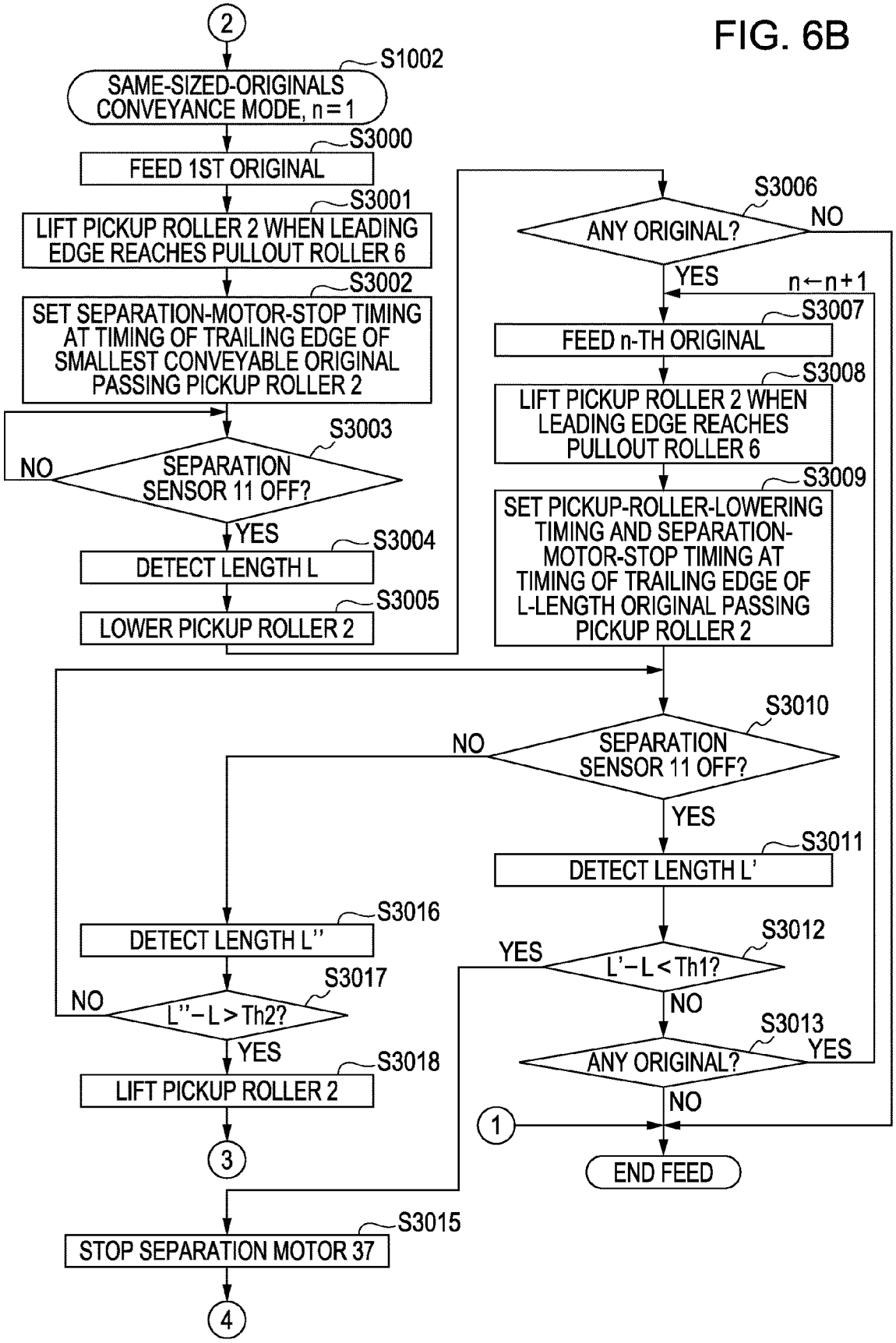
FIG. 6B
2
S1002
SAME-SIZED-ORIGINALS CONVEYANCE MODE, n=1
S3000
FEED 1ST ORIGINAL
S3001
LIFT PICKUP ROLLER 2 WHEN LEADING EDGE REACHES PULLOUT ROLLER 6
S3002
SET SEPARATION-MOTOR-STOP TIMING AT TIMING OF TRAILING EDGE OF SMALLEST CONVEYABLE ORIGINAL PASSING PICKUP ROLLER 2
S3003
SEPARATION SENSOR 11 OFF?
NO
YES
S3004
DETECT LENGTH L
S3005
LOWER PICKUP ROLLER 2
S3006
ANY ORIGINAL?
NO
YES
n←n+1
S3007
FEED n-TH ORIGINAL
S3008
LIFT PICKUP ROLLER 2 WHEN LEADING EDGE REACHES PULLOUT ROLLER 6
S3009
SET PICKUP-ROLLER-LOWERING TIMING AND SEPARATION-MOTOR-STOP TIMING AT TIMING OF TRAILING EDGE OF L-LENGTH ORIGINAL PASSING PICKUP ROLLER 2
S3010
SEPARATION SENSOR 11 OFF?
NO
YES
S3011
DETECT LENGTH L'
S3012
L'−L<Th1?
YES
NO
S3013
ANY ORIGINAL?
YES
NO
1
END FEED
S3016
DETECT LENGTH L''
S3017
L''−L>Th2?
NO
YES
S3018
LIFT PICKUP ROLLER 2
3
S3015
STOP SEPARATION MOTOR 37
4

ORIGINAL-FEEDING DEVICE

BACKGROUND OF THE INVENTION

1. Field of the Invention

The present invention relates to original-feeding devices.

2. Description of the Related Art

There is an increasing need for making copies and electronic data of various business forms used in offices. Accordingly, there is a demand for automatic original-conveying apparatuses capable of separating, conveying, and reading different kinds of originals at high speeds. An original-feeding device included in a typical automatic original-conveying apparatus basically includes a separator configured to separate one of stacked originals from the others and a feeder configured to feed an original to the separator. Such separators and feeders employ various methods, for example, a separation method employing a separation pad, and a retard separation method that provides a high conveyability in the conveyance of a cardboard and the like.

FIG. 8 is a schematic diagram showing transmission paths for drive signals and control signals in a typical original-feeding device of a retard-separation type. An original tray 501 receives one or more originals. A swing arm 510, functioning as a moving member, swingable about a support is provided above the original tray 501. The swing arm 510 has at an end thereof a pickup roller 502, functioning as an original feeder, configured to be in contact with the top one of the originals on the original tray 501 and to be rotatable in a direction in which the original is fed. The pickup roller 502 can be moved by the swing arm 510, configured to swing with a driving force transmitted from a pickup motor 539, between a pressing position and a retracted position. At the pressing position, the pickup roller 502 is pressed against the originals on the original tray 501 and feeds an original. At the retracted position, the pickup roller 502 is spaced apart from the originals. A pair of separation rollers 503, functioning as a separator, consists of a feed roller 504 and a retard roller 505 and is provided on the downstream side in the feed direction with respect to the pickup roller 502. The pair of separation rollers 503 conveys the original fed thereto further to the downstream side. The retard roller 505 is pressed against the feed roller 504 and receives a rotational driving force acting in such a direction as to feed back the original toward the original tray 501. If a plurality of originals are fed by the pickup roller 502, one of the originals is separated from the others while such originals are conveyed through and nipped by the pair of separation rollers 503. The rollers 504 and 505 are driven to rotate with driving forces transmitted from a single motor 537. The driving force for rotating the retard roller 505 is transmitted through a torque limiter (not shown) so that the retard roller 505 rotates in the direction opposite to the direction in which the original is conveyed. When the feed roller 504 pressed against the retard roller 505 is rotated in the conveyance direction, a torque acting in the conveyance direction is applied to the retard roller 505. The torque set in the torque limiter is smaller than that applied by the feed roller 504 to the retard roller 505. Therefore, when the feed roller 504 rotates, the retard roller 505 follows the rotation of the feed roller 504, thereby rotating in the conveyance direction. The pickup roller 502 often feeds two or more originals to the pair of separation rollers 503 (such a situation is referred to as multiple feeding). In such a situation, the coefficient of friction produced between the two or more originals is smaller than the coefficient of friction produced between the retard roller 505 and one of the originals. Therefore, the retard roller 505 receiving the driving force from the torque limiter acting in the direction opposite to the conveyance direction rotates in the direction opposite to the conveyance direction. Consequently, all the originals but the one at the top are fed back toward the original tray 501. Thus, the originals are conveyed one by one toward an image-forming device.

Usually, the pickup roller 502 is moved away from the originals at a predetermined timing after an original-feeding operation is started. When a sensor 511 detects the trailing edge of an original, the pickup roller 502 is brought into contact with the stack of originals for a subsequent feeding operation. An exemplary technique for increasing the number of conveyable originals per unit time is disclosed in Japanese Patent Laid-Open No. 2001-146329. In this technique, the timing at which the trailing edge of an original is released from the pair of separation rollers 503 is estimated from the length of the original and the time required for bringing the pickup roller 502 into contact with the stack of originals, and the pickup roller 502 is brought into contact with the stack of originals at the estimated timing.

There is a known automatic original-conveying apparatus having a function called a different-sized-originals conveyance mode in which each of a plurality of originals is subjected to size detection and is processed in accordance with the detected size. If the different-sized-originals conveyance mode is not set, processing is performed regardless of the sizes of the originals, that is, all the originals are treated as being of the same size. For example, all originals are treated as being of a size detected for a first original or a size designated by a user.

To improve the productivity in terms of original reading (the number of readable originals per unit time), the pickup roller 502 needs to be lowered as soon as possible after the separation of originals so as to be ready for a subsequent feeding operation. In the technique disclosed in Japanese Patent Laid-Open No. 2001-146329, if the different-sized-originals conveyance mode is not set, the pickup roller 502 is lowered before the trailing edge of an original passes the sensor 511, whereby the productivity is improved.

If, however, a stack of originals includes any originals having different lengths from the others despite the different-sized-originals conveyance mode not being set, the pickup roller 502 may be in contact with the stack of originals at a position deviated from the expected position.

FIGS. 9A and 9B show exemplary behavior of originals after the pickup roller 502 is lowered at a timing at which the trailing edge of an (N−1)-th original is assumed to have been released from the pair of separation rollers 503 in a case where an N-th original is of the A4 size and the (N−1)-th original is of the A3 size. In this case, to suppress the reduction in durability of the retard roller 505, the motor 537 is stopped immediately before the trailing edge of the (N−1)-th original (assumed to be of the A4 size) is assumed to be released from the pair of separation rollers 503. Therefore, in FIG. 9A, the (N−1)-th original is being conveyed by a pair of rollers 506 driven by a motor 538, and the pair of separation rollers 503 are rotating in the conveyance direction, following the movement of the (N−1)-th original. Meanwhile, the pickup roller 502 whose rotation is stopped is in contact with the (N−1)-th original. Under the weight of the pickup roller 502, a frictional force is produced between the (N−1)-th original and the N-th original. Consequently, as in FIG. 9B, the N-th original is dragged by the (N−1)-th original and may pass through the pair of separation rollers 503, that is, multiple feeding may occur.

FIGS. 10A to 10C show the behavior of the trailing edge of an (N−1)-th original in a case where an N-th original is of the A3 size and the (N−1)-th original is of the A4 size. In FIG.

10A, if the coefficient of friction produced between the (N−1)-th original and the N-th original is large, the N-th original is dragged to a position near the pair of separation rollers 503 by the (N−1)-th original. Besides, if the leading edge of the N-th original is folded or curled as in FIG. 10B, the N-th original may be drawn in by the feed roller 504 as in FIG. 10C. Consequently, the interval between the (N−1)-th original and the N-th original may be reduced, resulting in the possibility of a jam.

Thus, an automatic original-conveying apparatus of the retard-separation type employing the technique disclosed in Japanese Patent Laid-Open No. 2001-146329 for improvement of productivity in terms of original reading occasionally causes multiple feeding and jams if a stack of originals includes any originals having different lengths from the others.

SUMMARY OF THE INVENTION

The present invention provides an original-feeding device that is free from the problems described above.

The present invention also provides an original-feeding device capable of maintaining high productivity for a stack of same-sized originals and suppressing the occurrence of multiple feeding and jams for a stack of different-sized originals in a case where an original-feeding operation is controlled in a same-sized-originals conveyance mode.

According to an aspect of the present invention, an original-feeding device includes an original tray on which a plurality of originals are stacked, a pickup roller configured to be lowered onto the originals on the original tray and to feed one of the originals, the pickup roller configured to be lifted up after the feeding, a conveyor configured to convey the original fed by the pickup roller, a length detector configured to detect a length of the original, an original sensor configured to detect a trailing edge of the original conveyed by the conveyor, and a controller configured to control the pickup roller either in a first mode in which a timing of lowering the pickup roller is determined in accordance with a length of the original detected by the length detector or in a second mode in which the timing of lowering the pickup roller is determined in accordance with a timing at which a trailing edge of the original is detected by the original sensor. The controller changes from the first mode to the second mode if lengths of the originals detected by the length detector vary.

Further features of the present invention will become apparent from the following description of exemplary embodiments with reference to the attached drawings.

DESCRIPTION OF THE EMBODIMENTS

Embodiments of the present invention will now be described with reference to the accompanying drawings.

Image-Reading Apparatus

Figure 1:
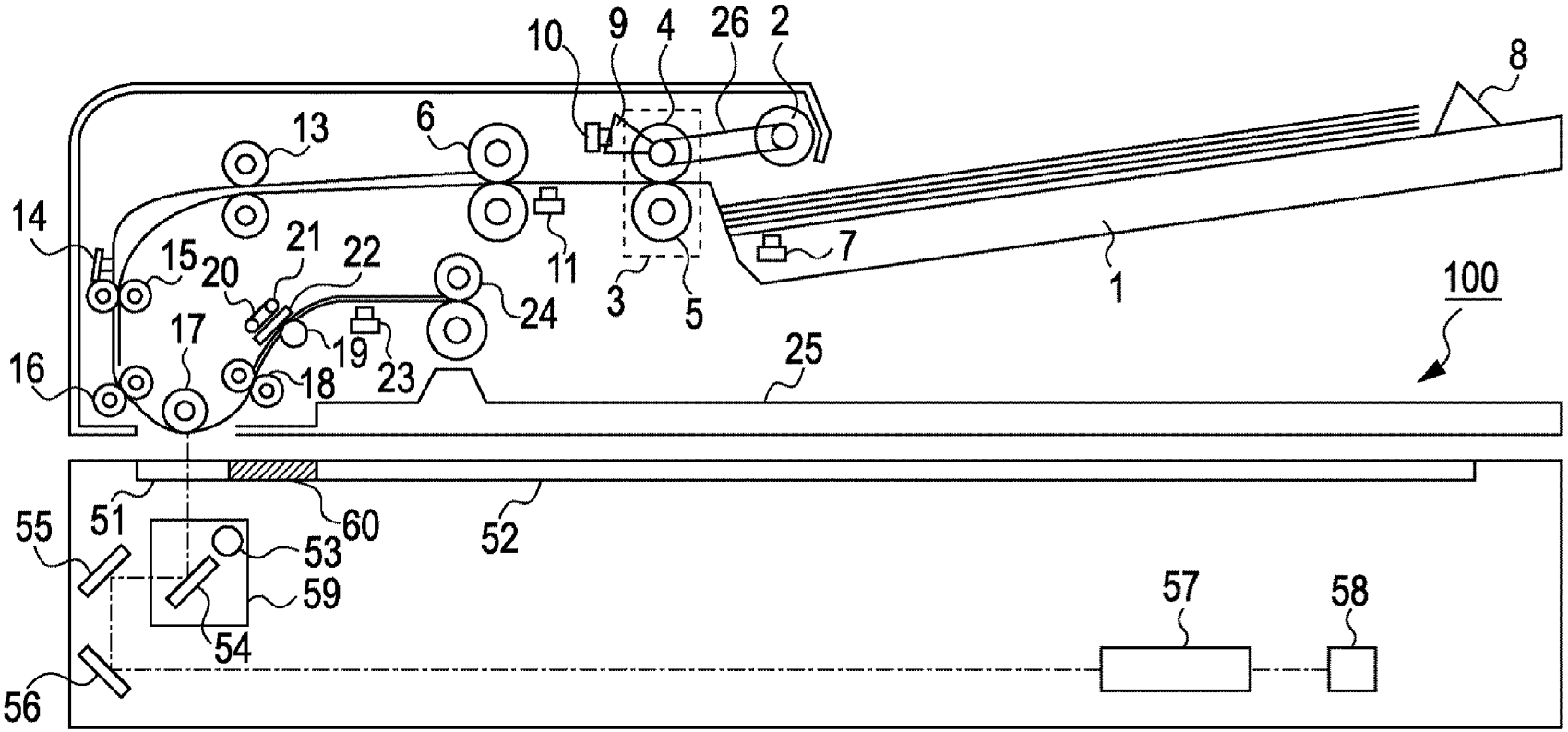
FIG. 1 is a cross-sectional view of an image-reading apparatus including an original-feeding device according to an embodiment of the present invention.

FIG. 1 is a cross-sectional view of an image-reading apparatus including an original-feeding device according to an embodiment of the present invention.

Referring to FIG. 1, an operation of "moving-original reading" will first be described in which an image of an original is read while the original is being conveyed. FIG. 1 shows an image-reading apparatus 100 including an original tray 1 and a pickup roller 2. The original tray 1 is movable up and down and receives a stack of one or more originals placed thereon. The pickup roller 2 is configured to be lowered onto an original at the top of the stack in feeding the original into the apparatus, and to be lifted up after the feeding. The image-reading apparatus 100 operates as follows. The pickup roller 2 is lowered before an original-feeding operation is started. Then, a lifter motor (not shown) is driven, whereby the original tray 1 is lifted up. When the top of the stack of originals reaches a feed position, a top-original sensor 10 detects a top-original detection flag 9 that rotates in conjunction with the pickup roller 2 that is in contact with the top of the stack. In response to an output from the top-original sensor 10, the lifting of the original tray 1 is stopped.

If a plurality of originals are fed by the pickup roller 2, one of the originals is separated from the others by a pair of separation rollers 3 consisting of a feed roller 4 and a retard roller 5. The separation is realized by a known retard-separation technique. The original separated from the others is conveyed by a pair of pullout rollers 6 and a pair of conveying rollers 13 while passing a separation sensor 11 and a registration sensor 14 and comes into contact with a pair of registration rollers 15, whereby the original has slack. With this slack, the obliqueness of the leading edge of the original is eliminated.

The original that has passed through the pair of registration rollers 15 is conveyed toward a platen glass 51, i.e., through a pair of upstream platen rollers 16 to a platen roller 17. The platen roller 17 is in contact with the platen glass 51. Therefore, the top surface of the original passing under the platen roller 17 is irradiated with a lamp 53. The reflection from the original is sequentially reflected by mirrors 54, 55, and 56, travels through a lens 57, and is received by a charge-coupled device (CCD) 58. Thus, an image on the top surface of the original is read. The original is further conveyed by the platen roller 17, passes through a pair of downstream platen rollers 18, and is conveyed to a back-surface-reading roller 19. The back-surface-reading roller 19 is in contact with a platen glass 22. Therefore, the back surface of the original passing over the back-surface-reading roller 19 is irradiated with a lamp 21. The reflection from the original is received by a contact image sensor (CIS) 20. Thus, an image on the back surface of the original is read. The original is further conveyed by the back-surface-reading roller 19, passes over a discharge sensor 23 and through a pair of discharge rollers 24, and is discharged onto an original discharge tray 25.

The original tray 1 is provided with a regulating guide plate (not shown) and an original-width sensor (not shown). The regulating guide plate is slidable in a direction (width direction) orthogonal to a direction in which the original is conveyed. The original-width sensor detects the width of the original in conjunction with the regulating guide plate. The original-width sensor, the registration sensor 14, the separation sensor 11, and an original sensor 8 in combination enable the identification of the size of the conveyed original. Before the reading of the original, a white plate 60 is read by the CCD 58, whereby shading is corrected. Thus, reference data on the white level for the top surface of the original is generated. Likewise, another white plate (not shown) provided on the platen glass 22 is read by the CIS 20, whereby shading is corrected. Thus, reference data on the white level for the back surface of the original is generated. The image-reading apparatus 100 can also operate in a stationary-original-reading mode in which an original placed on a glass 52 is read by the CCD 58 while a top-surface-reading unit 59 is slid toward right.

Description of Block Diagram

Figure 2:
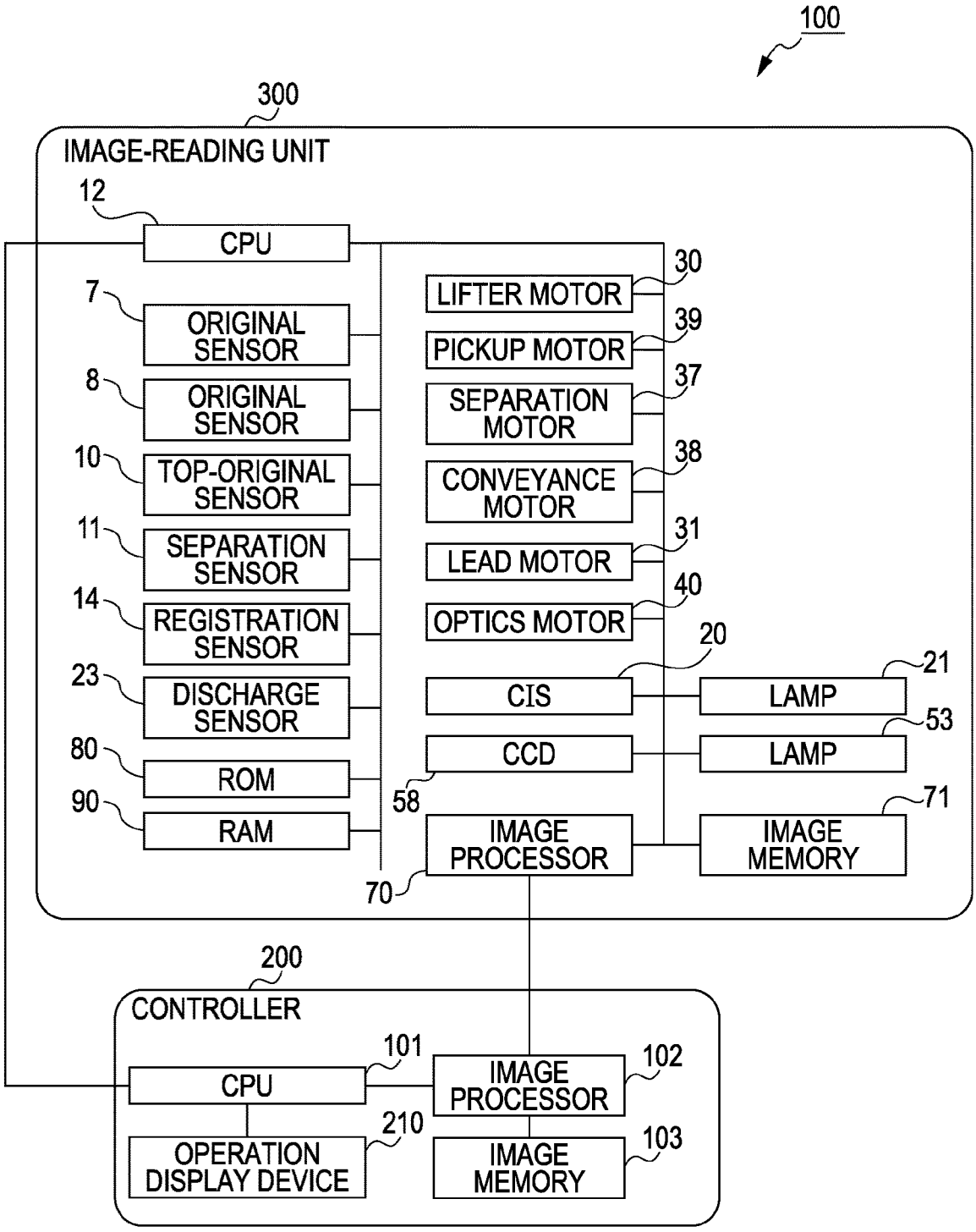
FIG. 2 is a block diagram of the image-reading apparatus.

FIG. 2 is a control block diagram of the image-reading apparatus 100 according to the embodiment. The image-reading apparatus 100 includes an image-reading unit 300 and a controller 200.

The image-reading unit 300 includes a central processing unit (CPU) 12, a read-only memory (ROM) 80, and a random access memory (RAM) 90. The ROM 80 stores control programs. The RAM 90 stores input data and work data. The image-reading unit 300 also includes a separation motor 37 that drives the pickup roller 2, the feed roller 4, and the retard roller 5 to rotate; a lifter motor 30 that lifts and lowers the original tray 1; a pickup motor 39 that lifts and lowers the pickup roller 2; a conveyance motor 38 that drives the pair of pullout rollers 6 and the pair of conveying rollers 13; a lead motor 31 that drives the pair of upstream platen rollers 16, the platen roller 17, the pair of downstream platen rollers 18, the back-surface-reading roller 19, and the pair of discharge rollers 24; an optics motor 40 that drives the top-surface-reading unit 59; an original sensor 7; the original sensor 8; the top-original sensor 10; the separation sensor 11; the registration sensor 14; the discharge sensor 23; the lamps 21 and 53; the CCD 58; the CIS 20; an image processor 70; and an image memory 71. Image data that is read by the CCD 58 or the CIS 20 is input to the image processor 70 and is then temporarily stored in the image memory 71.

The controller 200 includes a CPU 101, an image processor 102, an image memory 103, and an operation display device 210. The CPU 101 transmits and receives data on an image-reading control operation to and from the CPU 12 through a serial communication line provided therebetween. The image processor 102 transmits and receives image data to and from the image processor 70 through an image line provided therebetween. Data received from the image-reading unit 300 is stored in the image memory 103. A user-interface control operation is performed by the CPU 101 through the operation display device 210.

While the embodiment employs the CCD 58 for reading an image on the top surface of the original and the CIS 20 for reading an image on the back surface of the original, such image reading devices may be any other photoelectric conversion devices intended for image reading.

Operation Display Device

Figure 4A:
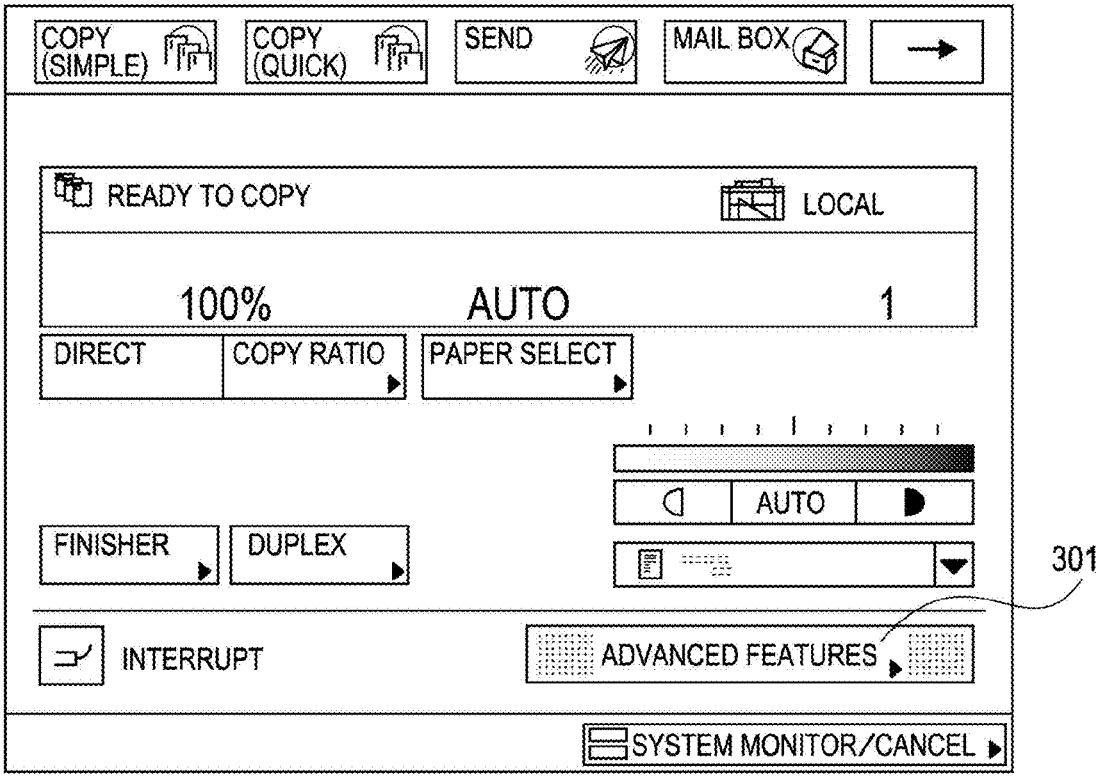
FIGS. 4A and 4B show screens of an operation display device.
Figure 4B:
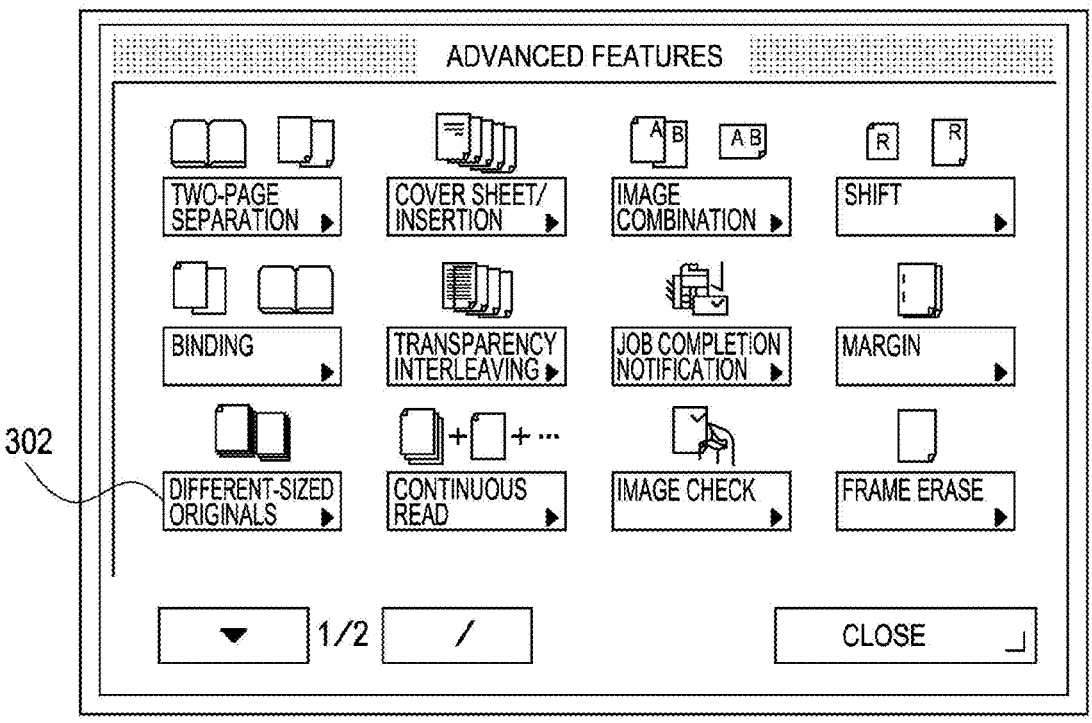

FIGS. 4A and 4B show the operation display device 210 of the image-reading apparatus 100. The operation display device 210 is included in the controller 200 shown in the block diagram in FIG. 2. The operation display device 210 has on the top thereof a liquid crystal display unit including a touch panel displaying a screen on which soft keys can be provided. To perform processing operations suitable for the individual sizes of the originals included in a stack of originals to be read, a user can set a different-sized-originals conveyance mode, corresponding to a second mode, through the operation display device 210. In the different-sized-originals conveyance mode, each of a plurality of originals is subjected to size detection, whereby a processing operation suitable for each detected size is performed. Referring to FIG. 4A, when an advanced features button 301 is pressed, a screen shown in FIG. 4B is displayed. When a different-sized-originals button 302 on the screen shown in FIG. 4B is pressed, the different-sized-originals conveyance mode is set. In a state where the different-sized-originals conveyance mode is not set, a same-sized-originals conveyance mode, corresponding to a first mode, is set. In the same-sized-originals conveyance mode, the image-reading apparatus 100 detects the size of a first one in a stack of originals, and second and subsequent originals are treated as being of the same size as the first one. That is, the operation display device 210 functions as a selector through which either of the different-sized-originals conveyance mode, i.e., the second mode, and the same-sized-originals conveyance mode, i.e., the first mode, is selected manually.

Mode-Setting Process

Figure 5:
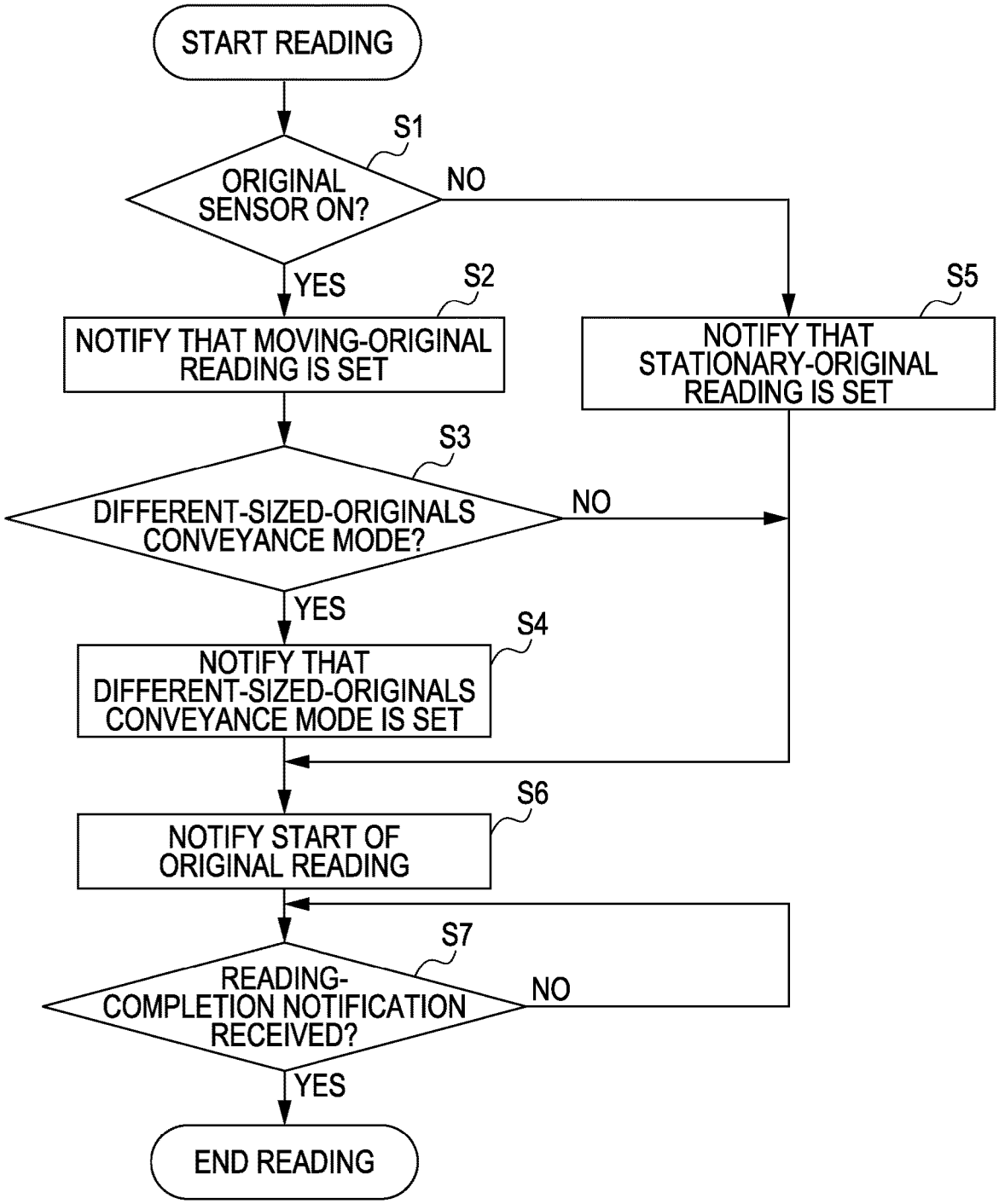
FIG. 5 is a flowchart of a control operation performed by a controller.

Referring to FIG. 5, the process of a control operation, from the start to end of the reading operation, performed by the CPU 101 of the controller 200 will now be described. When a start key (not shown) on the operation display device 210 is pressed by a user, the operation starts from step S1, in which the CPU 101 checks whether or not there are any originals on the original tray 1. Specifically, the CPU 101 communicates with the CPU 12 and acquires information indicating whether the original sensor 7 is on or off. If the CPU 101 determines that the original sensor 7 is on, that is, there are some originals on the original tray 1, the operation proceeds to step S2, in which the CPU 101 notifies the CPU 12 that a moving-original-reading mode is set. In step S3, the CPU 101 checks whether or not the different-sized-originals conveyance mode is set on the operation screen, shown in FIGS. 4A and 4B, by the user. If the different-sized-originals conveyance mode is set, the operation proceeds to step S4, in which the CPU 101 notifies the CPU 12 that the different-sized-originals conveyance mode is set. If the different-sized-originals conveyance mode is not set, it is assumed that the same-sized-originals conveyance mode is set. Not notifying that the different-sized-originals conveyance mode is set suggests that the same-sized-originals conveyance mode is set. Therefore, the CPU 101 does not notify the CPU 12 that the same-sized-originals conveyance mode is set, and the operation proceeds to step S6, in which the CPU 101 notifies the CPU 12 of the start of an original-reading operation. If the CPU 101 determines that the original sensor 7 is off, that is, there are no originals on the original tray 1, the operation proceeds to step S5, in which the CPU 101 notifies the CPU 12 of the start of the original-reading operation in the stationary-original-reading mode. Subsequently, in step S7, the CPU 101 stands by for notification from the CPU 12 indicating the completion of the reading operation in the image-reading unit 300, and, if the CPU 101 has received such notification, ends the reading operation.

Drive Mechanism of Original-Feeding Device

Figure 3:
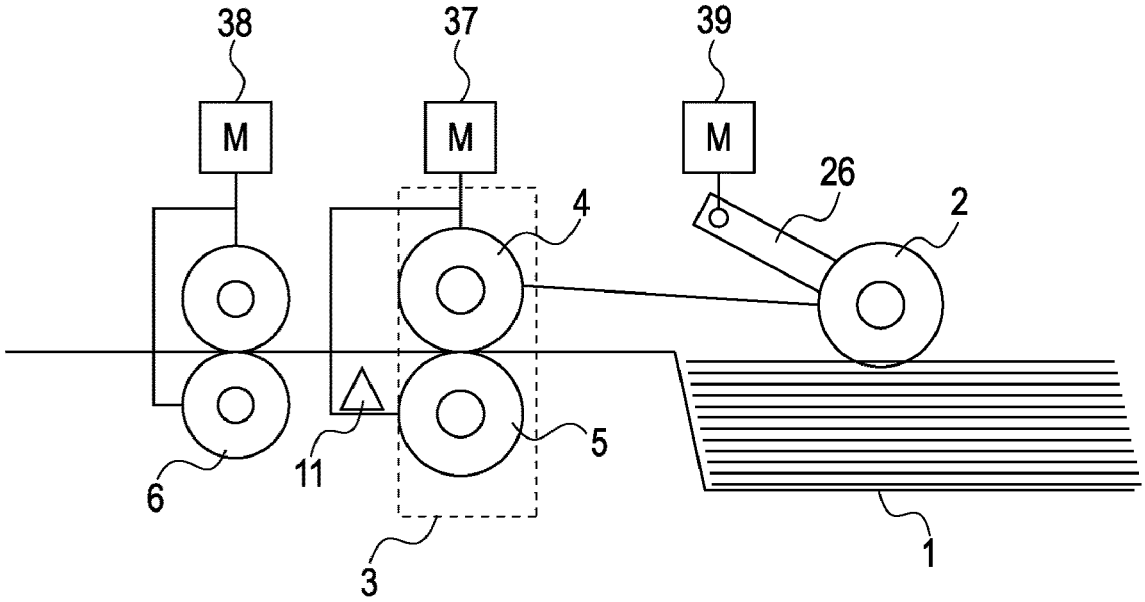
FIG. 3 shows a drive mechanism of the original-feeding device.

FIG. 3 shows a drive mechanism of the original-feeding device included in the image-reading apparatus 100 of the embodiment. A swing arm 26 swingable about a support is provided above the original tray 1 functioning as an original receiver. The swing arm 26 has at an end thereof the pickup roller 2 configured to be lowered onto the top of a stack of originals on the original tray 1 and to be rotatable in a direction in which the original is fed. The pickup roller 2 is movable between a pressing position and a retracted position. At the pressing position, the pickup roller 2 is pressed against the originals on the original tray 1 and feeds an original. At the retracted position, the pickup roller 2 is spaced apart from the originals. The pickup roller 2 is lifted and lowered by the swing arm 26 swung with a driving force transmitted from the pickup motor 39. The pair of separation rollers 3, functioning as a separator and consisting of the feed roller 4 and the retard roller 5, is provided on the downstream side with respect to the pickup roller 2, and conveys the original fed thereto further to the downstream side. The retard roller 5 is pressed against the feed roller 4 and receives a rotational driving force acting in such a direction as to feed back the original toward the original tray 1. The rollers 4 and 5 are driven to rotate with driving forces transmitted from a single separation motor 37. The driving force for rotating the retard roller 5 is transmitted through a torque limiter (not shown) so that the retard roller 5 rotates in the direction opposite to the conveyance direction. When the feed roller 4 pressed against the retard roller 5 is rotated in the conveyance direction, a torque acting in the conveyance direction is applied to the retard roller 5. If a plurality of originals are fed by the pickup roller 2, one of the originals is separated from the others while the originals are conveyed through the pair of separation rollers 3. The separated original passes the separation sensor 11 and is further conveyed through the pair of pullout rollers 6, which is driven by the conveyance motor 38, toward the downstream side.

Control Operation for Original-Length Detection

In the moving-original-reading mode, the length of an original that is being conveyed is detected as a time period from when the leading edge of the original reaches the registration sensor 14 (when the registration sensor 14 is turned on) until when the trailing edge of the original passes the separation sensor 11 (when the separation sensor 11 is turned off). When the length of a conveyance path from the separation sensor 11 to the registration sensor 14 is denoted by Lsr (270 mm in the embodiment); the speed of original conveyance is denoted by Vf (610 mm/sec in the embodiment); the time when the registration sensor 14 is turned on is denoted by Tr-on; and the time when the separation sensor 11 is turned off is denoted by Ts-off, the length L of the original is calculated as follows:

If Tr-on≧Ts-off, $$L = Lsr - Vf \times (Tr\text{-on} - Ts\text{-off}) \quad (1)$$

If Tr-on<Ts-off, $$L = Lsr + Vf \times (Ts\text{-off} - Tr\text{-on}) \quad (2)$$

The values of Vf and Lsr are stored in the ROM 80 in advance. The above calculation is performed by the CPU 12 for each original, and the result of the calculation is stored in the RAM 90.

Alternatively, the length of an original may be calculated from the conveyance speed and the time period from when the separation sensor 11 detects the leading edge of the original until when the separation sensor 11 detects the trailing edge of the original.

Different-Sized-Originals Conveyance Mode

Figure 6:
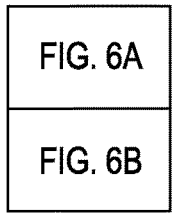
FIGS. 6A and 6B are flowcharts of an original-feeding control operation.
Figure 6A:
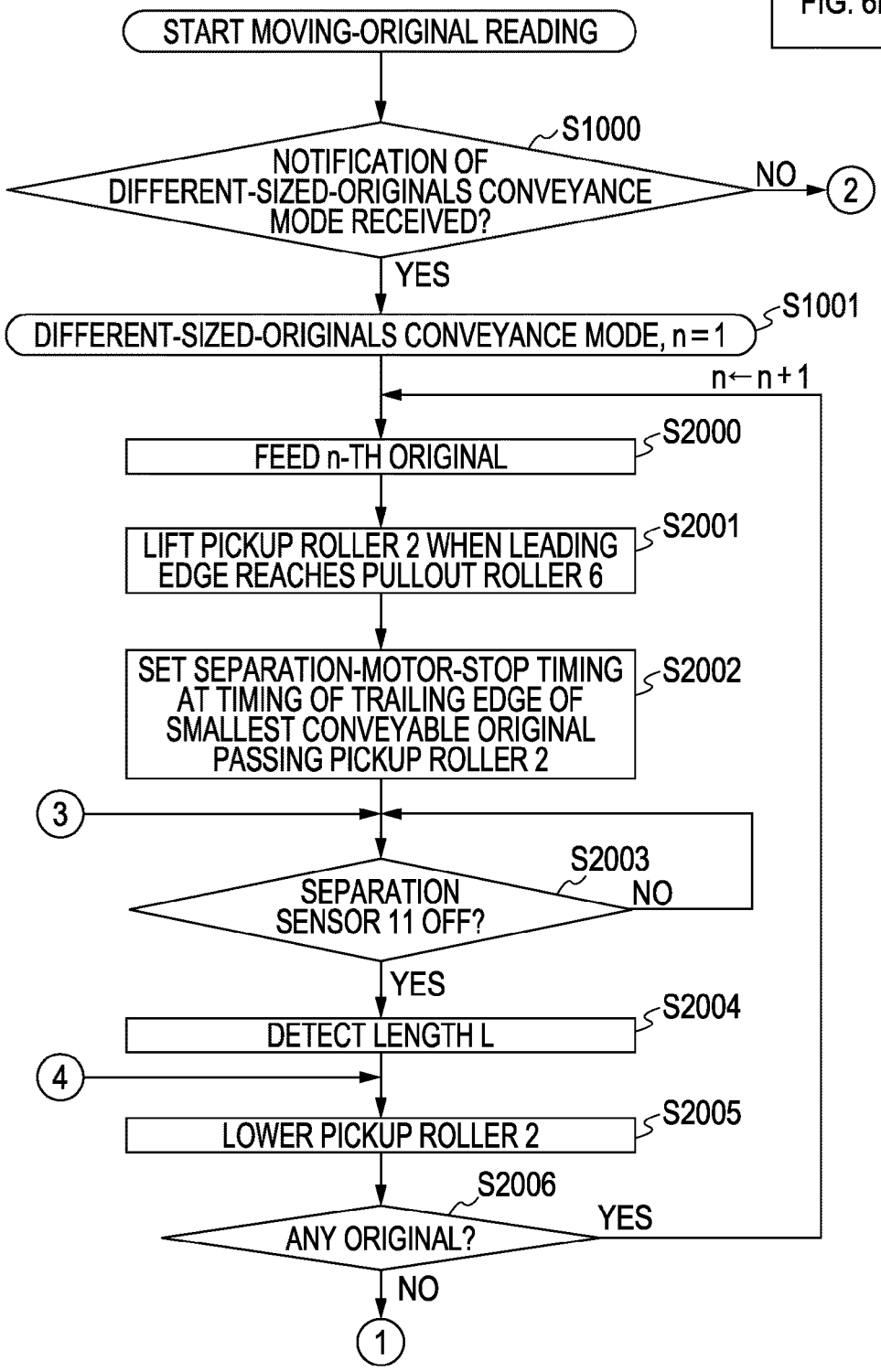

FIGS. 6A and 6B are flowcharts of an original-feeding control operation performed by the CPU 12 of the image-reading unit 300 when the start of the original-reading operation in the moving-original-reading mode is notified from the controller 200.

In step S1000, the CPU 12 checks whether or not notification has been received from the controller 200 (the CPU 101) that the different-sized-originals conveyance mode has been set. If notification has been received that the different-sized-originals conveyance mode has been set, the operation proceeds to step S1001, in which the CPU 12 initiates an operation in the different-sized-originals conveyance mode under the assumption that originals having different lengths are placed on the original tray 1. In step S2000, the CPU 12 causes the pickup roller 2 to be lowered and the separation motor 37 to be driven, thereby starting the feeding of a first original. In step S2001, after a predetermined time period from when the leading edge of the first original is detected by the separation sensor 11, the CPU 12 determines that the leading edge has reached the pair of pullout rollers 6, and causes the pickup motor 39 to rotate, thereby lifting up the pickup roller 2.

In step S2002, the CPU 12 sets the timing of stopping the separation motor 37 at the timing at which the trailing edge of an original having the smallest size (length) that is conveyable by the original-feeding device is assumed to be released from the pickup roller 2. In the embodiment, the B6 size is the smallest conveyable size. In the different-sized-originals conveyance mode, the timing of stopping the separation motor 37 is set for each original on the basis of the smallest size. In accordance with the set timing, the CPU 12 stops the separation motor 37 by using a timer function (not shown). Subsequently, in step S2003, the CPU 12 checks whether or not the trailing edge of the first original has passed the separation sensor 11 and the leading edge of the first original has reached the registration sensor 14, that is, whether or not the separation sensor 11 has been turned off and the registration sensor 14 has been turned on. If it is determined that the separation sensor 11 has been turned off and the registration sensor 14 has been turned on, the operation proceeds to step S2004, in which the CPU 12 calculates the length L of the first original in accordance with the control operation for original-length detection, i.e., Expression 1 or 2, and notifies the controller 200 of the result of the calculation. The size of the original may alternatively calculated only on the basis of the detection by the separation sensor 11, as mentioned above. In step S2005, in response to the separation sensor 11 having been turned off, the CPU 12 causes the pickup motor 39 to rotate, thereby lowering the pickup roller 2. In this case, the separation sensor 11 functions as an original sensor that detects the trailing edge of an original. In step S2006, if the original sensor 7 is in an on state, the CPU 12 determines that some originals remain on the original tray 1. Then, the operation returns to step S2001, in which the CPU 12 drives the separation motor 37, whereby feeding of a second original is started. The feeding operation described above is repeated until the original sensor 7 is turned off.

Figure 7A:
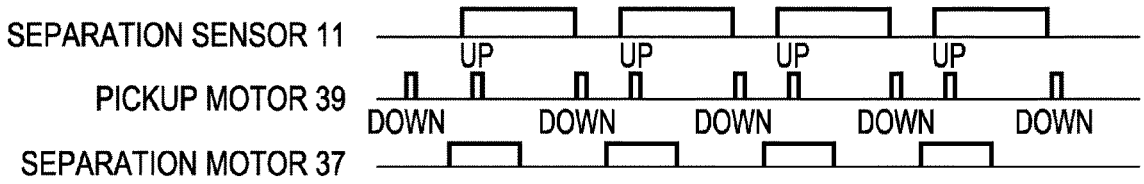
FIGS. 7A to 7D are timing charts of the original-feeding control operation.

FIG. 7A is a control timing chart in the different-sized-originals conveyance mode. An output signal of the separation sensor 11 is shown at the top, a drive signal of the pickup motor 39 is shown in the middle, and a drive signal of the separation motor 37 is shown at the bottom. In the different-sized-originals conveyance mode, the timing of stopping the separation motor 37 corresponds to the timing at which the trailing edge of an original of the smallest conveyable size (the B6 size) is assumed to be released from the pickup roller 2. This means that, at the time when the trailing edge of an original is released from the pair of separation rollers 3 (when the separation sensor 11 is turned off), the separation motor 37 has already been stopped. In addition, as can be seen in FIG. 7A, the pickup roller 2 is lowered after the separation sensor 11 is turned off. That is, the pickup roller 2 is lowered after the trailing edge of an original is surely released from the pickup roller 2. Therefore, the productivity is lower than in the same-sized-originals conveyance mode described below. Instead, the occurrence of multiple feeding and jams described referring to FIGS. 9A to 10C is prevented. If a sensor that detects the trailing edge of an original can be provided between the separation sensor 11 and the original tray 1, the pickup roller 2 may be lowered at a timing at which the sensor that is in an on state is turned off.

Same-Sized-Originals Conveyance Mode

A control operation performed by the CPU 12 of the image-reading unit 300 in a case where notification was not received from the controller 200 that the different-sized-originals conveyance mode had been set in the moving-original-reading mode will now be described with reference to the flowcharts in FIGS. 6A and 6B. If notification was not received that the different-sized-originals conveyance mode had been set in step S1000, the operation proceeds to step S1002, in which the CPU 12 initiates an operation in the same-sized-originals conveyance mode under the assumption that originals having the same length are placed on the original tray 1. First, in step S3000, the CPU 12 drives the separation motor 37 with the pickup roller 2 being at the pressing position, thereby starting the feeding of a first original. In step S3001, after a predetermined time period from when the leading edge of the first original is detected by the separation sensor 11, the CPU 12 determines that the leading edge has reached the pair of pullout rollers 6, and causes the pickup motor 39 to rotate, thereby lifting up the pickup roller 2.

In step S3002, the CPU 12 sets the timing of stopping the separation motor 37 at the timing at which the trailing edge of an original having the smallest size (the B6 size) that is conveyable by the original-feeding device is assumed to be released from the pickup roller 2. In step S3003, the CPU 12 checks whether or not the trailing edge of the first original has passed the separation sensor 11, that is, whether or not the separation sensor 11 has been turned off and the registration sensor 14 has been turned on. If it is determined that the separation sensor 11 has been turned off and the registration sensor 14 has been turned on, the operation proceeds to step S3004, in which the CPU 12 calculates the length L of the first original in accordance with the control operation for original-length detection, i.e., Expression 1 or 2, and notifies the controller 200 of the result of the calculation. As mentioned above, the size of the original may alternatively calculated only on the basis of the detection by the separation sensor 11. In step S3005, in response to the separation sensor 11 having been turned off, the CPU 12 causes the pickup motor 39 to rotate, thereby lowering the pickup roller 2. If the original sensor 7 is in the on state after the lowering of the pickup roller 2, the operation proceeds to step S3006, in which the CPU 12 determines that some originals remain on the original tray 1. Then, in step S3007, the CPU 12 drives the separation motor 37, whereby feeding of a second original is started.

After the feeding of the second original is started, the operation proceeds to step S3008, in which the CPU 12 causes the pickup motor 39 to rotate at the timing at which the leading edge of the second original reaches the pair of pullout rollers 6, thereby lifting up the pickup roller 2. In step S3009, the CPU 12 sets the timing of stopping the separation motor 37 at the timing at which the leading edge of the second original reaches the pair of pullout rollers 6. For feeding of each of third and subsequent originals, the CPU 12 determines the timing at which the trailing end of each original is assumed to be released from the pickup roller 2 in accordance with the length L detected for the first original. On the basis of the timing determined as above and by using the timer function (not shown), the CPU 12 causes the pickup motor 39 to rotate so as to lower the pickup roller 2, and stops the separation motor 37.

Subsequently, in step S3010, the CPU 12 checks whether or not the separation sensor 11 has been turned off and the registration sensor 14 has been turned on. If it is determined that the separation sensor 11 has been turned off and the registration sensor 14 has been turned on, the operation proceeds to step S3011, in which the CPU 12 calculates a length L' of the second original in accordance with Expression 1 or 2. In step S3012, the CPU 12 checks whether or not the value obtained by subtracting the length L of the first original from the length L' is smaller than a predetermined length Th1 (50 mm in the embodiment). If a relationship of $L'-L<Th1$ holds true, the operation proceeds to step S3015, in which the CPU 12 determines that the second original is shorter than the first original, and stops the separation motor 37. Then, the operation proceeds to step S2005, in which the CPU 12 lowers the pickup roller 2, and switches the operation to the different-sized-originals conveyance mode.

If the separation sensor 11 is in an on state in step S3010, the operation proceeds to step S3016, in which a length L" is calculated in accordance with Expression 1 or 2 under the assumption that the separation sensor 11 is turned off at the time of the check in step S3010. Then, in step S3017, the CPU 12 checks whether or not the value of $L''-L$ is larger than a predetermined length Th2 (50 mm in the embodiment). If a relationship of $L''-L>Th2$ holds true, the operation proceeds to step S3018, in which the CPU 12 determines that the second original is longer than the first original, immediately lifts up the pickup roller 2 that was lowered in accordance with the length of the first original, and switches the operation to the different-sized-originals conveyance mode. That is, if the separation sensor 11 stays on even after the assumed timing of the trailing edge of the original passing the separation sensor 11 calculated in accordance with the length of the first original, the CPU 12 immediately lifts up the pickup roller 2 and switches the operation to the different-sized-originals conveyance mode. If, in step S3017, it is not determined that the length L" of the second original is larger than the length L of the first original by the predetermined length Th2 or more, the CPU 12 continues to check the states of the separation sensor 11 and the registration sensor 14 in step S3010 every predetermined period of time until the separation sensor 11 is turned off. In the embodiment, the predetermined period of time is set to 10 msec.

If, in step S3012, the relationship of $L'-L<Th1$ does not hold true, the operation proceeds to step S3013, in which the CPU 12 determines that the first and second originals are of the same size, and the same-sized-originals conveyance mode is retained, whereby the feeding operation is repeated until the original sensor 7 is turned off.

Figure 7B:
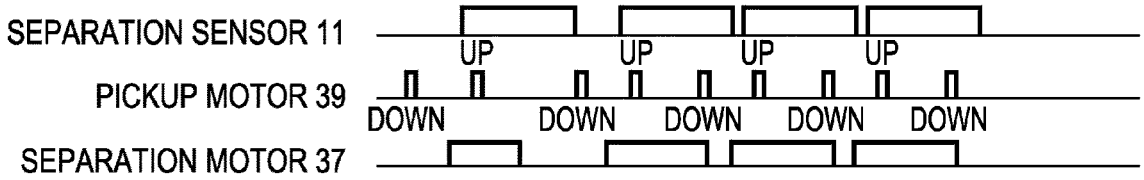
Figure 7C:
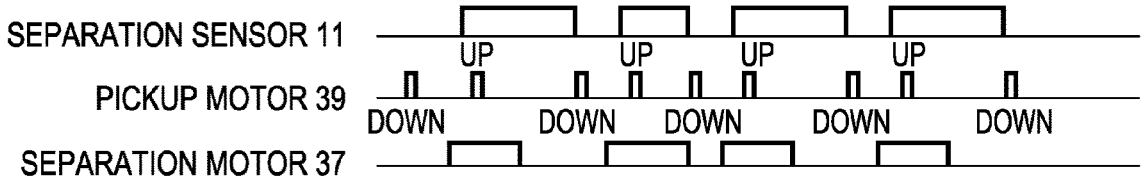
Figure 7D:
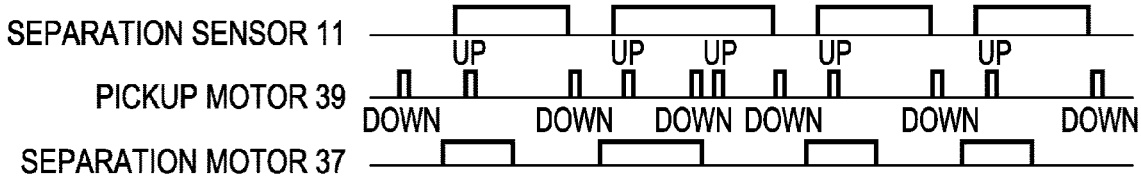
Figure 8:
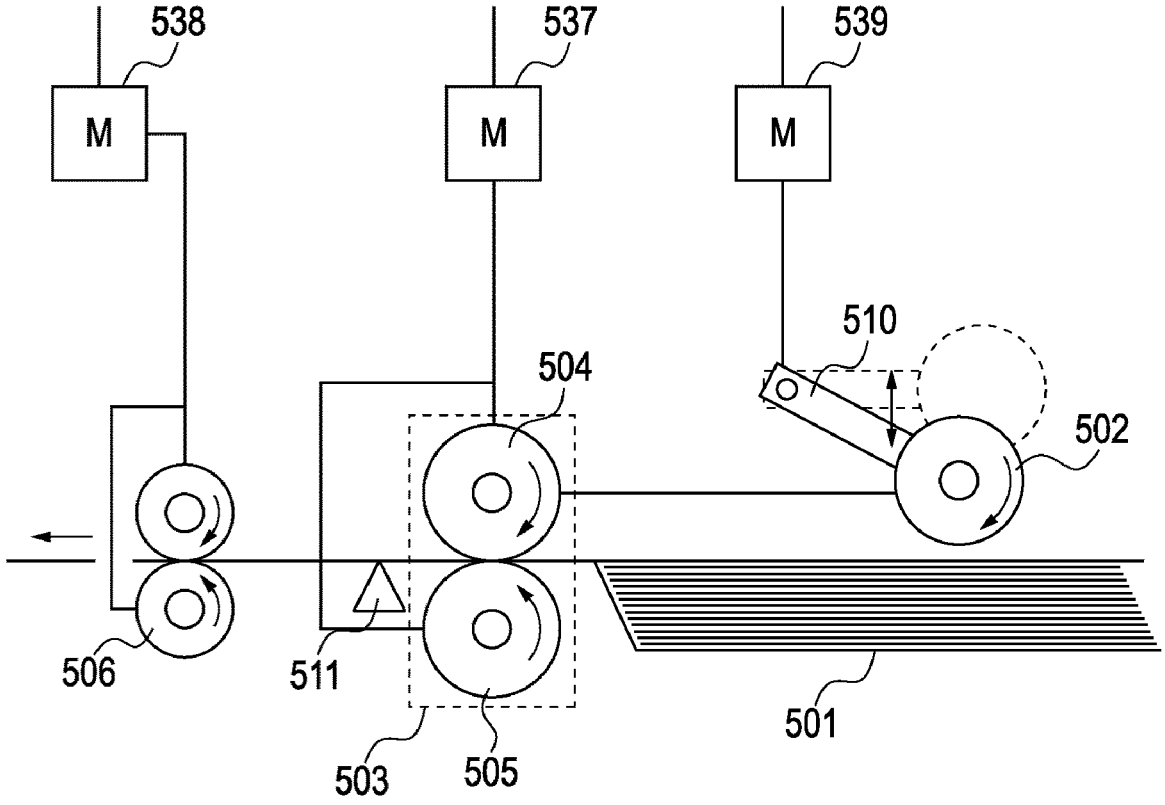
FIG. 8 is a schematic diagram showing a drive mechanism of a known original-feeding device.
Figure 9A:
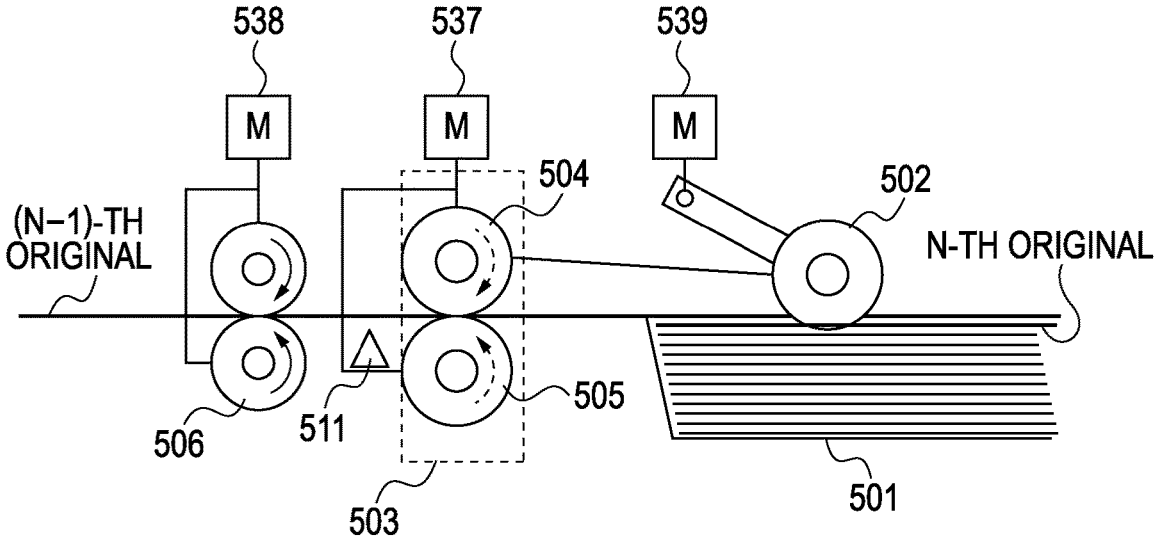
FIGS. 9A and 9B are diagrams showing the occurrence of multiple feeding in a known original-feeding operation.
Figure 9B:
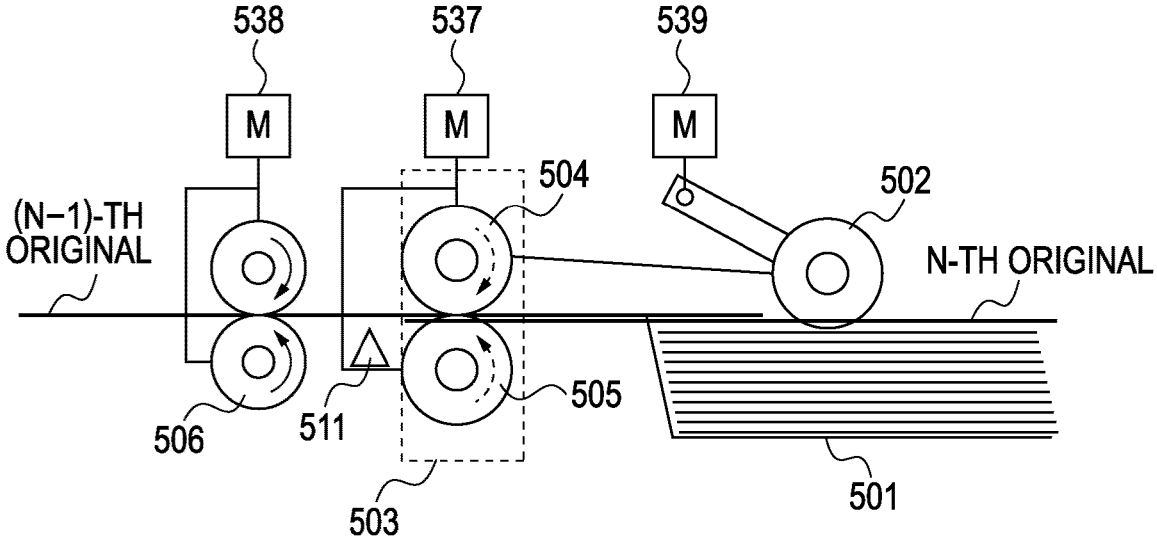
Figure 10A:
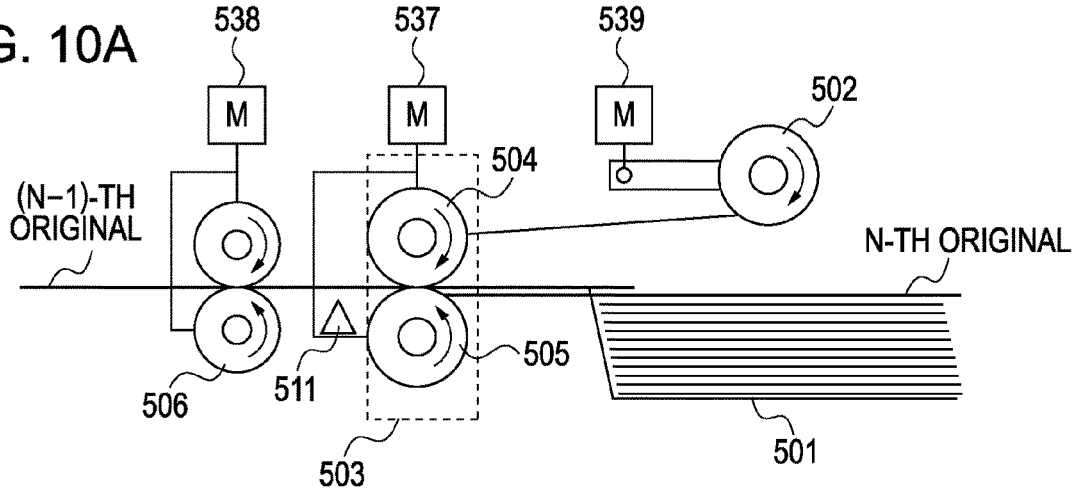
FIGS. 10A to 10C are diagrams showing the occurrence of a jam in a known original-feeding operation.
Figure 10B:
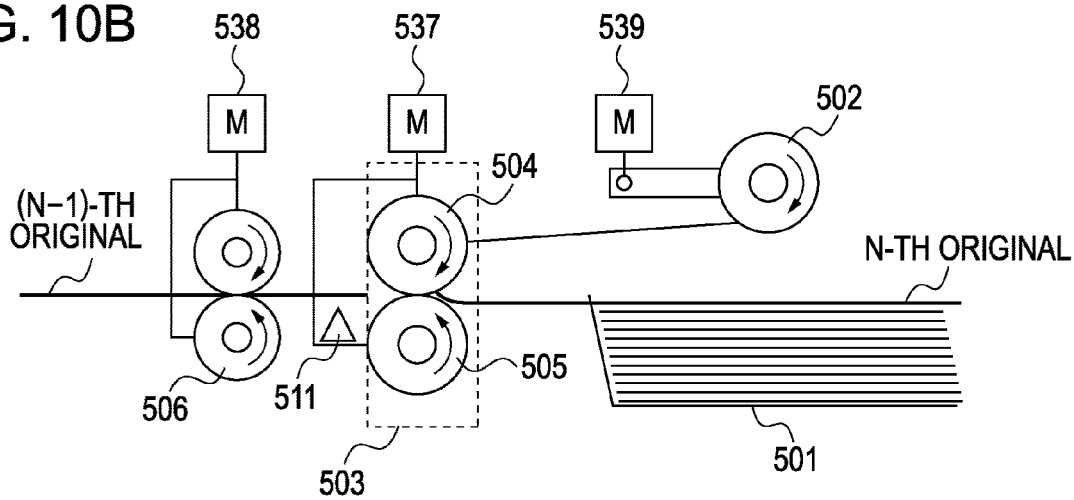
Figure 10C:
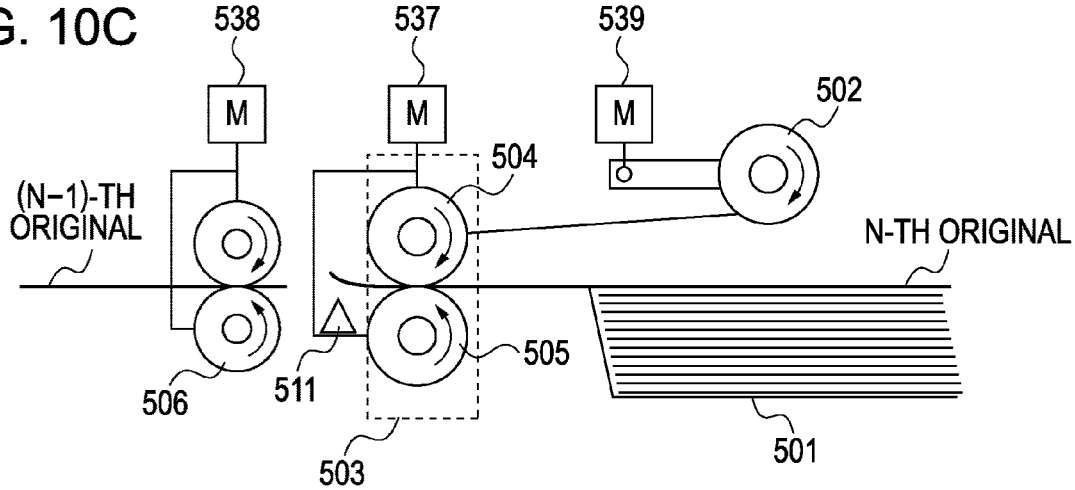

FIGS. 7B to 7D are control timing charts in the same-sized-originals conveyance mode. As in the chart shown in FIG. 7A, in each of the FIGS. 7B to 7D, the output signal of the separation sensor 11 is shown at the top, the drive signal of the pickup motor 39 is shown in the middle, and the drive signal of the separation motor 37 is shown at the bottom.

FIG. 7B is a timing chart in the same-sized-originals conveyance mode and in a case where all originals are of the same size. In this case, the timing of stopping the separation motor 37 and the timing of lowering the pickup roller 2 are set at the timing at which an original having a length the same as the detected length of the first original is assumed to be released from the pickup roller 2. Therefore, if all originals are of the same size, the occurrence of multiple feeding and jams described referring to FIGS. 9A to 10C is prevented. Moreover, for each of third and subsequent originals, the pickup roller 2 is lowered, in accordance with the length of the first original, before the separation sensor 11 is turned off. Thus, a preparatory action for feeding a subsequent original is made quickly, whereby high productivity can be maintained.

FIG. 7C is a timing chart in the same-sized-originals conveyance mode but in a case where the second original is shorter than the first original. In this case, when the separation sensor 11 is turned off at the passage of the trailing edge of the second original, it is determined that the second original is shorter than the first original, and the separation motor 37 is immediately stopped. Thus, the occurrence of drawing of a subsequent original into the pair of separation rollers 3 described referring to FIGS. 10A to 10C can be suppressed.

FIG. 7D is a timing chart in the same-sized-originals conveyance mode but in a case where the second original is longer than the first original. In this case, after the pickup roller 2 is lowered for feeding of the third original in accordance with the size of the first original, the separation sensor 11 is not turned off at the timing assumed in accordance with the size of the first original. In such a situation, it is determined that the second original is longer than the first original, and the pickup roller 2 is immediately lifted up. Thus, the occurrence of multiple feeding involving the subsequent original, such as the phenomenon described referring to FIGS. 9A and 9B, can be suppressed.

To summarize, in the same-sized-originals conveyance mode, the timing of stopping the separation motor 37 and the timing of lowering the pickup roller 2 are set, in accordance with the length of the first original, at a timing before the trailing edge of an original passes the separation sensor 11. Thus, compared with the case in the different-sized-originals conveyance mode, a subsequent original is quickly made ready to be fed, whereby productivity in terms of original reading can be improved. Even in the same-sized-originals conveyance mode, if it is detected that the lengths of the second and subsequent originals differ from the length of the first original, it is highly possible that the remaining originals may include originals of different sizes. Therefore, the same-sized-originals conveyance mode is cancelled, and the operation is switched to the different-sized-originals conveyance mode. Thus, if all originals are of the same size, high productivity can be maintained. Moreover, even if some of originals have different lengths from the others, the occurrence of multiple feeding and jams can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321631 filed Dec. 17, 2008, which is hereby incorporated by reference herein in its entirety.

What is claimed is:

1. An original-feeding device comprising:

an original tray on which a plurality of originals are stacked;

a pickup roller configured to be lowered onto the originals on the original tray and to feed one of the originals, the pickup roller configured to be lifted up after the feeding;

a conveyor configured to convey the original fed by the pickup roller;

a length detector configured to detect a length of the original;

an original sensor configured to detect a trailing edge of the original conveyed by the conveyor; and a controller configured to control the pickup roller either in a first mode in which a timing of lowering the pickup roller is determined in accordance with a length of the original detected by the length detector or in a second mode in which the timing of lowering the pickup roller is determined in accordance with a timing at which a trailing edge of the original is detected by the original sensor, wherein the controller changes from the first mode to the second mode if lengths of the originals detected by the length detector vary, and wherein, in the first mode, the controller stops conveying of the conveyor in response to the length detector detecting that the lengths of the originals vary into a smaller size.

2. The original-feeding device according to claim 1, wherein, in the first mode, the controller determines the timing of lowering the pickup roller onto originals subsequent to one of the originals in accordance with the length of the one of the originals.

3. The original-feeding device according to claim 1, wherein, in the first mode, the controller causes the pickup roller, which has been lowered, to be lifted up in response to the length detector detecting that the lengths of the originals vary into a larger size.

4. The original-feeding device according to claim 1, wherein the conveyor is a separator configured to separate the originals fed by the pickup roller.

5. The original-feeding device according to claim 4, wherein the original sensor is provided on a downstream side with respect to the separator.

* * * * *